US011820125B2

(12) United States Patent
Meyers et al.

(10) Patent No.: US 11,820,125 B2
(45) Date of Patent: Nov. 21, 2023

(54) PRINTING SYSTEM AND METHOD INCLUDING PRINTING ROLL HAVING ELASTICALLY DEFORMABLE AND COMPRESSIBLE THICK INNER LAYER

(71) Applicant: 3M INNOVATIVE PROPERTIES COMPANY, St. Paul, MN (US)

(72) Inventors: Kara A. Meyers, Oakdale, MN (US); Shawn C. Dodds, St. Paul, MN (US); Mikhail L. Pekurovsky, Bloomington, MN (US); Tyler J. Rattray, Woodbury, MN (US); James N. Dobbs, Woodbury, MN (US); Samad Javid, Woodbury, MN (US); Matthew S. Stay, Bloomington, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 17 days.

(21) Appl. No.: 17/597,562

(22) PCT Filed: Jul. 13, 2020

(86) PCT No.: PCT/IB2020/056563

§ 371 (c)(1),
(2) Date: Jan. 11, 2022

(87) PCT Pub. No.: WO2021/014268

PCT Pub. Date: Jan. 28, 2021

(65) Prior Publication Data

US 2022/0250375 A1 Aug. 11, 2022

Related U.S. Application Data

(60) Provisional application No. 62/876,040, filed on Jul. 19, 2019.

(51) Int. Cl.
*B41F 5/04* (2006.01)
*B41F 5/24* (2006.01)

(52) U.S. Cl.
CPC . *B41F 5/04* (2013.01); *B41F 5/24* (2013.01)

(58) Field of Classification Search
CPC ... B41F 5/04; B41F 5/24; B41F 13/10; B41M 1/02; B41M 1/04; B41N 1/12; B41N 1/22
See application file for complete search history.

(56) References Cited

U.S. PATENT DOCUMENTS 5,752,444 A 5/1998 Lorig
6,079,329 A 6/2000 Goovaard
(Continued)

FOREIGN PATENT DOCUMENTS

EP 1190867 3/2002
EP 1762397 3/2007
(Continued)

OTHER PUBLICATIONS

Bould, "An Investigation into Quality Improvements in Flexographic Printing", Proceedings of the Institution of Mechanical Engineers. Part B, Journal of Engineering Manufacture, Nov. 2004, vol. 218, No. 11, p. 1499-1511.
(Continued)

*Primary Examiner* — Matthew G Marini
*Assistant Examiner* — Leo T Hinze
(74) *Attorney, Agent, or Firm* — Thomas M. Spielbauer

(57) ABSTRACT

A printing system (200) including a printing roll (220) is provided. The printing roll (220) includes an elastically deformable and compressible inner layer (224) and a thin outer shell (222) to cover the inner layer (224). The thin outer shell (222) includes a pattern of raised print features (223) to receive ink material thereon. The inner layer (224) is softer and thicker than the thin outer shell (222), and
(Continued)

optionally, the thin outer shell (222) is removable from the inner layer (224). The inner layer (224) of the printing roll (220) has a thickness, a compression force deflection value and an elastically-deformable compressibility such that the raised print features (223) of the printing roll (220) do not slide or deform with respect to the printed web (2) in an amount to generate a substantially visible dot gain.

17 Claims, 11 Drawing Sheets

(56) References Cited

U.S. PATENT DOCUMENTS

| | | | |
|---|---|---|---|
| 6,276,271 | B1 | 8/2001 | Busshoff |
| 6,456,818 | B1 | 9/2002 | Nakayama |
| 9,156,299 | B2 | 10/2015 | Amiel-Levy |
| 2012/0103216 | A1 | 5/2012 | Knisel |
| 2014/0202348 | A1 | 7/2014 | Fuellgraf |
| 2014/0345482 | A1 | 11/2014 | Fuellgraf |
| 2016/0096390 | A1 | 4/2016 | Nakano |
| 2018/0339536 | A1* | 11/2018 | Shirakawa ..... B41C 1/05 |
| 2019/0001660 | A1* | 1/2019 | Kohlweyer ..... B41M 1/04 |

FOREIGN PATENT DOCUMENTS

| | | |
|---|---|---|
| WO | WO2011-139215 | 11/2011 |
| WO | WO2017-008922 | 1/2017 |
| WO | WO2019-102295 | 5/2019 |
| WO | WO2020-121121 | 6/2020 |

OTHER PUBLICATIONS

Young, Roark's Formulas for Stress and Strain, 193 (1989).
International Search Report for PCT International Application No. PCT/IB2020/056563 dated Oct. 5, 2020, 6 pages.

* cited by examiner

Example 3

Comparative Example 2

Comparative Example 3

D

PRINTING SYSTEM AND METHOD INCLUDING PRINTING ROLL HAVING ELASTICALLY DEFORMABLE AND COMPRESSIBLE THICK INNER LAYER

CROSS REFERENCE TO RELATED APPLICATIONS

This application is a national stage filing under 35 U.S.C. 371 of PCT/IB2020/056563, filed Jul. 13, 2020, which claims the benefit of U.S. Application No. 62/876,040, filed Jul. 19, 2019, the disclosure of which is incorporated by reference in its/their entirety herein.

BACKGROUND

Flexographic printing technology is widely used as a graphics based printing method, targeting the packaging and labeling industry. Flexographic printing can support a wide variety of substrates and inks, while delivering product at high line speeds. A rubber or photopolymer stamp with a foam backing is known in the art for use in flexographic printing. Flexographic printing typically involves applying a relatively thick (e.g., about 1.5 to 2 mm) photopolymer printing plate, which is usually backed with a substantially stiff layer of polyethylene terephthalate (PET) to a steel plate roll using a thin (e.g., about 0.25 to 0.5 mm), double-sided foam tape. FIG. 1A is a schematic cross-sectional diagram of a flexographic printing system 100, including a rigid anilox roll 110 with an ink supply 112; a steel plate cylinder 120 with a polymeric plate 122 mounted on a foam flexo tape 124; a rigid steel impression cylinder 130; and a substrate 2 upon which the polymeric plate prints an ink pattern 142.

SUMMARY

Printing systems and methods for printing ink patterns having high dimensional stability and high-resolution features are provided. Briefly, in one aspect, a method of printing a pattern of features onto a web is provided. The method includes providing a printing roll. The printing roll includes an elastically deformable and compressible inner layer and a thin outer shell to cover the inner layer. The thin outer shell includes a pattern of raised print features to receive ink material thereon. The inner layer is softer and thicker than the thin outer shell. The method further includes supplying a liquid ink onto the pattern of raised print features of the printing roll; and applying an impression force to press the printing roll and the web against each other to transfer the liquid ink from the printing roll to the web to form the pattern of features.

In another aspect, a printing system is provided. The printing system includes a printing roll including an elastically deformable and compressible inner layer and a thin outer shell to cover the inner layer. The thin outer shell includes a pattern of raised print features to receive ink material thereon. The inner layer is softer and thicker than the thin outer shell. The thin outer shell and the inner layer have a thickness ratio not greater than about 0.5. The printing system further includes an impression roll positioned adjacent to the printing roll, a nip formed between the printing roll and the impression roll, and a flexible web being advanced along the machine direction through the nip.

In another aspect, a printing roll is provided. The printing roll includes an elastically deformable and compressible inner layer; and a thin outer shell to cover the inner layer. The thin outer shell includes a pattern of raised print features to receive ink material thereon, the inner layer is softer and thicker than the thin outer shell, and the thin outer shell and the inner layer have a thickness ratio not greater than about 0.5.

Various unexpected results and advantages are obtained in exemplary embodiments of the disclosure. One such advantage of exemplary embodiments of the present disclosure is that the inner layer of the printing roll has sufficient thickness, and low compression force deflection and high elastically-deformable compressibility such that any deformation of the printing roll in the nip region can be accommodated by the inner layer to obtain a pattern of features on a moving web without substantial ghosting or smearing defects.

Various aspects and advantages of exemplary embodiments of the disclosure have been summarized. The above Summary is not intended to describe each illustrated embodiment or every implementation of the present disclosure. The Drawings and the Detailed Description that follow more particularly exemplify certain preferred embodiments using the principles disclosed herein.

BRIEF DESCRIPTION OF THE DRAWINGS

The disclosure may be more completely understood in consideration of the following detailed description of various embodiments of the disclosure in connection with the accompanying figures, in which.

Figure 1A:
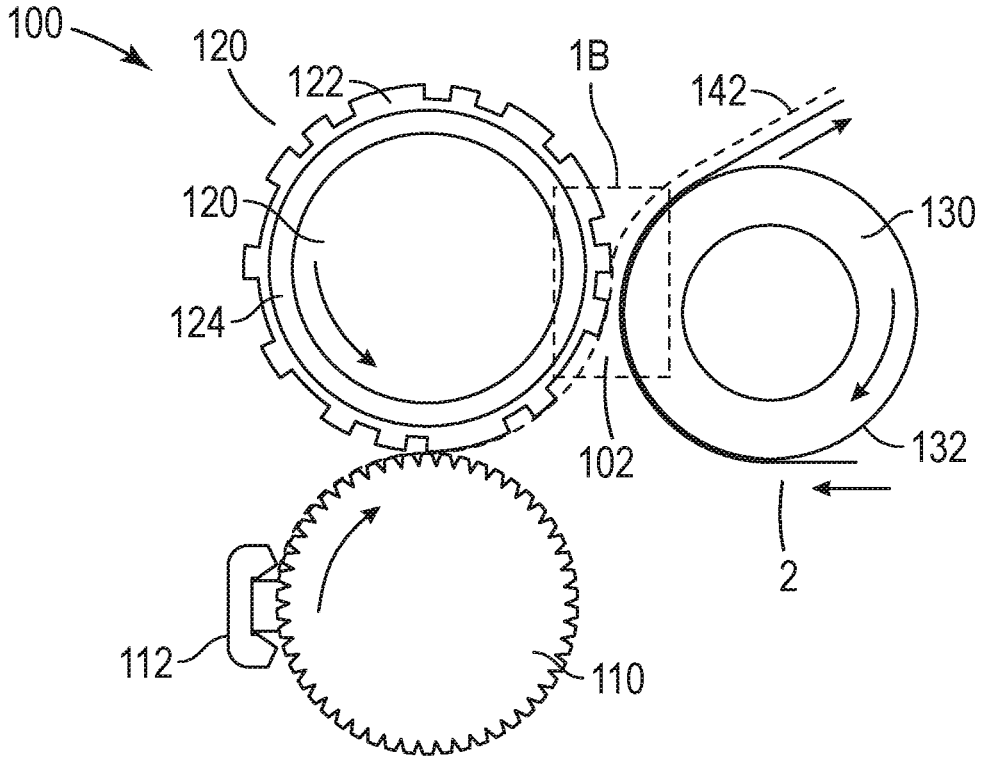
FIG. 1A Prior Art
FIG. 1A is a schematic cross-sectional diagram of a flexographic printing system, according to the prior art.

In the drawings, like reference numerals indicate like elements. While the above-identified drawings, which may not be drawn to scale, set forth various embodiments of the present disclosure, other embodiments are also contemplated, as noted in the Detailed Description. In all cases, this disclosure describes the presently disclosed disclosure by way of representation of exemplary embodiments and not by express limitations. It should be understood that numerous other modifications and embodiments can be devised by those skilled in the art, which fall within the scope and spirit of this disclosure.

DETAILED DESCRIPTION

For the following Glossary of defined terms, these definitions shall be applied for the entire application, unless a different definition is provided in the claims or elsewhere in the specification.

Glossary

Certain terms are used throughout the description and the claims that, while for the most parts are well known, may require some explanation. It should be understood that:

The term "rigid" refers to an object that has a high flexural stiffness. For a block of homogeneous material with a constant cross-section, the flexural stiffness (k) may be calculated using following equation: $k=E*I/(1-nu^2)$, where E is the Young's modulus, I is the second moment of a cross-sectional area, and nu is the Poisson's ratio. E and nu are intrinsic material properties, and I is a function of the geometry of the construction. For a slab of material that has thickness t, and width W, the second moment of an area per unit width is proportional to the cube of the thickness and flexural stiffness k is equal to $E*t^3/(12*(1-nu^2))$. When that slab of material is simply supported at the bottom by two parallel ridges separated by a distance L, and loaded on the top with force per unit length of P, the middle of the slab deflects toward the bottom by the distance $Y=5*P*L^4/(384*k*W)$. These formulas can be found in Roark's Formulas for Stress and Strain, $6^{th}$ ed, NY: McGraw-Hill, 1989, pg. 193. For reference, a typical flexographic printing plate may have a thickness of about 1.5 mm, an elastic modulus of about 3.6 megaPascals (MPa), and Poisson's ratio of about 0.43 (Bould, D. C., An Investigation into Quality Improvements in Flexographic Printing, PhD thesis, University of Wales, Swansea, 2001). Such a typical flexographic plate may have a flexural stiffness of about 0.001242 $Pa \cdot m^3$.

The term "elastic" refers to the ability of an object to recover its shape when a deforming force or pressure is removed. The term "deformable" refers to a material that changes its shape and/or volume due to an external applied load. For example, if a nip is formed between a steel roll and a rubber roll, the shape of the rubber roll may noticeably change as it is engaged into the steel roll. In other words, the rubber roll is highly deformable when compared to the steel roller. The term "elastically-deformable" refers to an object (e.g., a thin shell) being capable of recovering to substantially 100% (e.g., 99% or more, 99.5% or more, or 99.9% or more) of its original state upon removal of a stress or pressure that caused the distortion (e.g., deformation) of the original shape.

The terms "compressible" or "incompressible" refer to a material property, i.e., compressibility, of an object (e.g., an elastomeric layer) which is a measure of the relative volume change of the material in response to a pressure. For example, the term "substantially incompressible" refers to a material whose volume does not change significantly under pressure. Compressibility or incompressibility for solid-state materials can be expressed by their Poisson's ration. In the present disclosure the term "substantially incompressible" refers to a material having a Poisson's ratio greater than about 0.45.

The term "compression force deflection" refers to the pressure required to deflect a flexible cellular material, such as urethane foams, to 25% of its undeformed thickness. Compression force deflection is used to express the firmness of cellular materials and may be measured via Compression Force Deflection Testing per ASTM D3574.

The term "integral" refers to being composed of portions that together constitute a whole article, as opposed to portions that can be separated from each other without causing damage to the article. For instance, a first part that is attached to a second part with a bolt are not integral to each other, and the first part can be removed from the second part by removing the bolt and without damaging the article, whereas two integrally formed parts would have to be cut, broken, etc., to separate them.

The term "nip" refers to a system of two rolls with (i) a gap between adjacent first and second rolls where the distance between the center of the first and second rolls is greater than or equal to the sum of the radii of the two rolls, or (ii) an impression engagement between adjacent first and second rolls when the distance between the center of the first and second rolls is less than the sum of the radii of the two rolls in undeformed state. A typical gap might be, for example, from about 1 micrometer to about 1 mm, or about 10 micrometers to about 500 microns. The impression engagement could be as much as can be obtained without damaging the printing equipment.

The term "anilox roll" or "inking roll" refers to a roll that has an array of microwells (also called cells) used to carry the printing ink. The cells can be produced with various shapes by any suitable techniques or methods, all of which are well known in the printing industry. An anilox roll typically has a rigid surface.

The term "impression roll" refers to a roll that forms a nip with a printing roll where ink is brought into contact with a substrate and produce a printed pattern on the substrate. An impression roll is typically a rigid, steel roll, but may also be an elastomer.

The term "plate roll" or "printing roll" refers to a roll which contains a printing pattern on a major surface thereof. The plate roll is nipped with an impression engagement both with an anilox roll (which allows ink to transfer to the surface of the plate roll) and with an impression roll (which allows ink to transfer to the substrate, forming a pattern). Specific constructions of a plate roll are described in more detail below.

The term "ceramic" includes glass, crystalline ceramic, glass-ceramic, and combinations thereof. The term "glass" refers to amorphous material exhibiting a glass transition temperature. The term "glass-ceramic" refers to ceramic comprising crystals formed by heat-treating glass. The term "amorphous material" refers to material derived from a melt and/or a vapor phase that lacks any long-range crystal structure as determined by X-ray diffraction and/or has an exothermic peak corresponding to the crystallization of the amorphous material as determined by Differential Thermal Analysis.

The term "metal" refers to an opaque, fusible, ductile, and typically lustrous substance that is a good conductor of electricity and heat, forms a cation by loss of electron(s), and yields basic oxides and hydroxides.

The term "plastic" as used herein, refers to any one of rigid organic materials that are typically thermoplastic or thermosetting polymers of high molecular weight and that can be made into objects (e.g., layers or cores).

The terms "polymer" or "polymers" includes homopolymers and copolymers, as well as homopolymers or copolymers that may be formed in a miscible blend, e.g., by coextrusion or by reaction, including, e.g., transesterification. The term "copolymer" includes random, block and star (e.g. dendritic) copolymers.

In this application, the term "machine direction" or "down-web direction" refers to the direction in which the web (e.g., substrate) travels. Similarly, the term cross-web refers to the direction perpendicular to the machine direction (i.e., perpendicular to the direction of travel for the web), and in the plane of the top surface of the web.

As used in this specification and the appended embodiments, the singular forms "a", "an", and "the" include plural referents unless the content clearly dictates otherwise. Thus, for example, reference to layers containing "a metal" includes a mixture of two or more metals. As used in this specification and the appended embodiments, the term "or" is generally employed in its sense including "and/or" unless the content clearly dictates otherwise.

As used in this specification, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof.

Flexographic printing is a relief-based printing technique that applies discontinuous coatings utilizing raised features on a surface of a printing roll (e.g., a flexible polymeric plate or laser engraved rubber) as an image carrier. The raised features of the printing roll are typically inked via an inking roll. The inking roll can be, for example, an anilox roll, which is a continuously engraved roll of precision microwells, configured to transfer a specific volume of ink from the wells onto the raised features of the image carrier (e.g., a printing plate mounted on the surface of the printing roll). This ink is subsequently transferred from the image carrier onto a substrate. A schematic of a conventional flexographic printing system 100 can be found in FIG. 1A, including a rigid anilox roll 110 with an ink supply 112; a cylinder 120 with a printing plate 122 mounted, via a foam flexo tape 124 on a steel roll 126; a rigid steel impression cylinder 130 having a major surface 132; and a substrate 2 upon which the polymeric plate prints an ink pattern 142.

The printing plate 122 typically is a polymeric plate including a photopolymer printing plate backed with a substantially stiff PET layer. A typical printing plate has a thickness of about 1.5 mm to 2.0 mm. The printing plate 122 is substantially incompressible. The polymeric plate 122 is attached to the steel roll 126 via the double-sided foam tape 124. Once mounted on the steel roll 126, the foam tape 124 may not be removable without damage. The foam tape 124 typically is much thinner than the polymeric plate 122, having a thickness in the range from about 0.25 mm to 0.5 mm. The thickness ratio between the polymeric plate 122 and the foam tape 124 typically is in the range from about 1 to about 25.

Figure 1B:
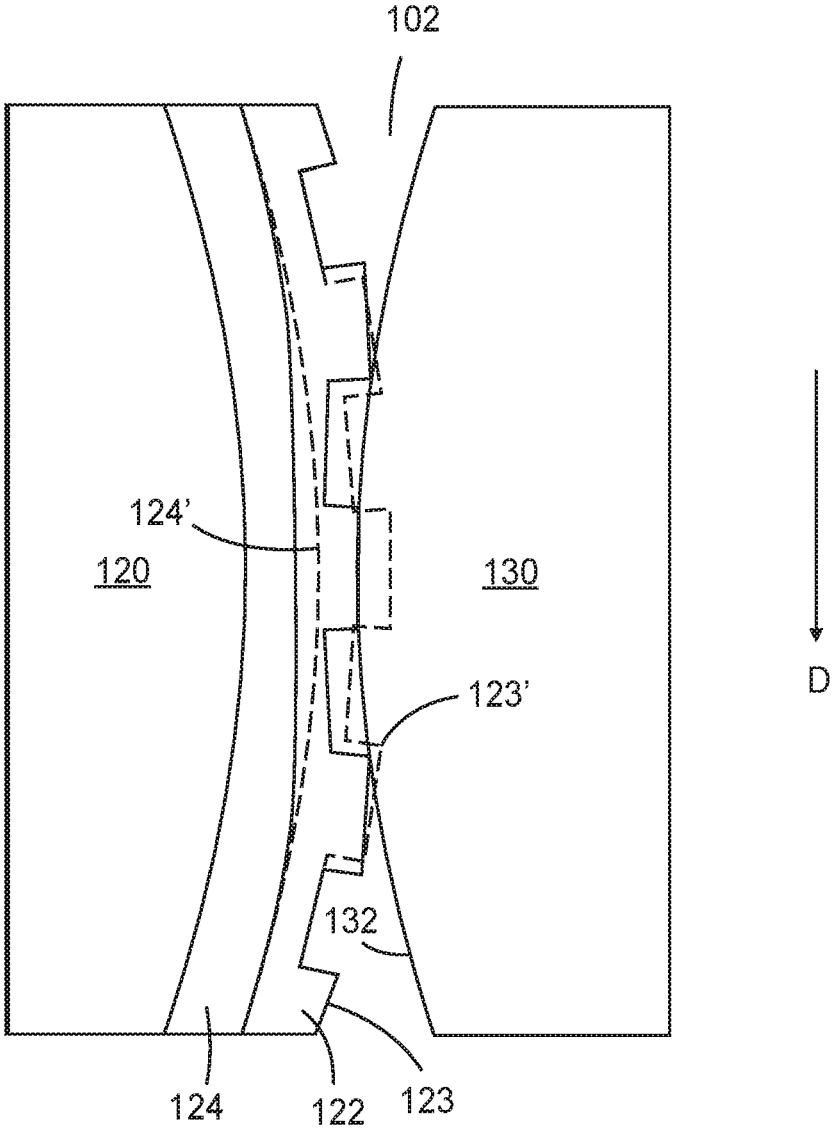
FIG. 1B is an enlarged portion view of the printing system of FIG. 1A.

Further, referring to FIG. 1B, a schematic side view of a portion of the printing plate 122 mounted on the thin foam tape 124 and engaging with the rigid steel impression cylinder 130, in which the raised features 123 on the printing plate 122 are highly exaggerated. Under a certain impression force, the raised features 123 on the deformable flexographic printing plate 122 contact a moving web (not shown in FIG. 1B, see the web 2 wrapping around the major surface 132 of the impression cylinder 130 in FIG. 1A) in the nip region 102, to allow transfer of ink from the raised features 123 of the deformable flexographic printing plate 122 onto the moving web. When the impression force applied between the printing roll 120 and the impression cylinder 130 increases, the printing plate 122 may deform or even slide with respect to the surface 132 of the impression cylinder 130 and the moving web thereon. See, for example, the raised features 123 change from its previous position shown by a dotted line 123', and the thin foam tape 124 changes from its previous position shown by a dotted line 124'.

Figure 1C:
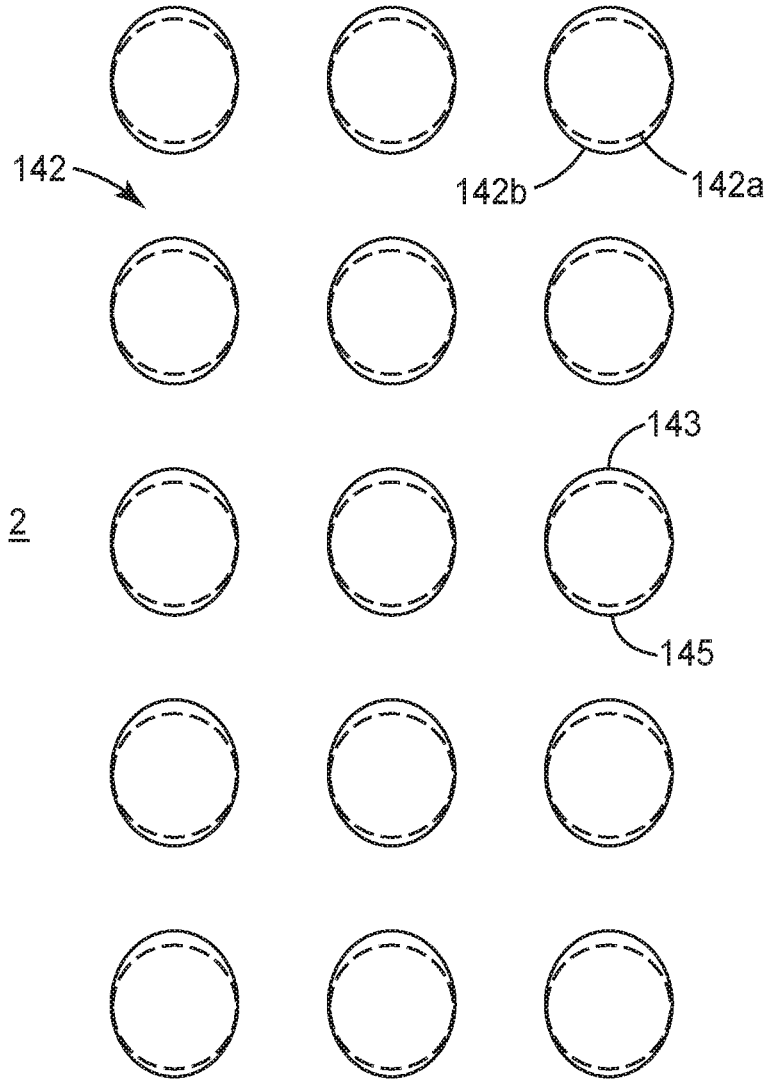
FIG. 1C illustrates a pattern of printed features on the web having a print feature growth.

While not wanting to be bound by theory, it is believed that the foam tape 124 is too thin to accommodate the entirety of deformation of the printing plate 122 induced by the impression force, in particular, the deformation in the radial direction. Thus, the raised features 123 of the printing plate 122 may deform or slide on the moving web 2 and lead to an apparent "growth" of printing features thereon. As illustrated in FIG. 1C, a pattern of features 142 is printed onto the moving web 2 when pressing the printing roll 120 and the impression roll 130 against each other to transfer the ink material from the raised features to the web 2. During the contact between the printing roll 120 and the impression roll 130 in the nip region 102, when the raised features 123 of the printing plate 122 deforms and/or slides with respect to the web 2, mainly in the machine direction "D," the printed feature 142 grows from its designed shape 142*a* to its actual shape 142*b* as shown in FIG. 1C.

The print feature growth as shown in FIG. 1C is primarily along the machine direction "D." When a certain raised feature 123 enters or exits the nip 102, it may deform or slide with respect to the moving web 2, leaving the print feature growth on opposite ends 143 and 145 of the printed feature. Such print feature growth can result in the formation of smearing or ghosting defects, e.g., at the opposite ends 143 and 145 of the printed feature. It is to be understood that the print feature growth may also form along the cross web direction. In general, the formation of smearing or ghosting defects may be attributed to the deformation and/or the sliding motion of the raised features with respect to the moving web. Higher line speed and/or greater impression force may induce greater deformation and/or sliding motion and thus more smearing or ghosting defects.

The smearing or ghosting defects can be quantified by a dot gain or feature spreading. The term "dot gain" refers to the ratio of the observed dimension (e.g., diameter, length, width, etc.) of a printed feature divided by the designed dimension (e.g., diameter, length, width, etc.) of that printed feature. For example, a printing surface may be constructed to print an array of circles with a 1.0 mm diameter, while the printed feature has a diameter of 1.1 mm, which represents a dot gain of 10%. In the present disclosure, a substantially visible dot gain refers to a dot gain of 5% or more, 10% or more, 15% or more, 20% or more, or 30% or more. The term "feature spreading" refers to the difference, as opposed to the ratio, of the observed printed dimension (e.g., diameter, length, width, etc.) to the designed dimension (e.g., diameter, length, width, etc.). For the previous example, the feature spreading is about 0.1 mm.

In contrast to a conventional flexographic printing system, a printing system was prepared in the present application including a printing roll having a thin outer shell and a thick elastically deformable and compressible inner layer. More particularly, referring to FIG. 2A, a schematic cross-sectional view of a printing system 200 is shown. The printing system of FIG. 2A includes a printing roll 220 having a thin outer shell 222 and a thick inner layer 224. The thin outer shell 222 includes a printing pattern 223 thereon configured to receive an ink material from an inking roll 210 positioned adjacent to the printing roll 220.

The inking roll 210 includes an inking surface 212 that may include a plurality of cells (not shown) disposed thereon. In some embodiments, the inking surface 212 may be a rigid surface. This printing system 200 further includes an applicator 214 configured to coat the ink material onto at least a portion of the inking surface 212 of the inking roll 210. The embodiment shown in FIG. 2A further includes an impression roll 230 positioned adjacent to the printing roll 220 to form a nip 202. The printing system 200 also includes a substrate 2 provided through the nip 202 when the rolls rotate in the respective directions. The ink material is transferred from the inking surface 212 of the inking roll 210 onto the thin outer shell 222 of the printing roll 220. The printing roll 220 and the impression roll 230 are pressed against each other to transfer the ink material from the printing roll 220 to the substrate 2 in the nip 202.

The thin outer shell 222 encases the inner layer 224 to mount on a central core 226. The thin outer shell 222 includes a printing pattern 223 thereon. The inner layer 224 is thicker and softer than the thin outer shell 222. In some embodiments, the thin outer shell 222 is substantially incompressible, but can deflect in unison with the elastically deformable and compressible inner layer 224 such that the thin outer shell 222 can be elastically deformed at the respective nips by contact with the inking roll 210 or the impression roll 230.

In some embodiments, the thin outer shell may include one or more materials of an elastomer, a metal, a fabric, or a nonwoven. The elastically deformable and compressible inner layer may include one or more materials of a synthetic foam, an engraved, structured, 3D printed, or embossed elastomer, a fabric or nonwoven layer, a plurality of cavities filled with gas of a controlled pressure, or a soft rubber.

In some embodiments, the inner layer 224 may be deformable and capable of preventing slip between the thin outer shell 222 and the inner layer 224. In some embodiments, the inner layer 224 may be made of a soft foam. In some embodiments, the inner layer 224 may include a patterned elastomer that allows the inner layer 224 to be effectively compressible. The patterned elastomer may have patterned structures (e.g., engraved surface structures) located on the outer surface thereof that contacts to the thin outer shell 222. The patterned structure may be formed with any suitable techniques including, for example, engraving, ablating, molding, etc.

In some embodiments, the material used for the inner layer 224 can be softer than the material used for the outer layer 222. In general, an identical compressive force applied to an identically sized block of each material can result in a larger deformation in the direction of applied force with the softer material than with the harder material. The softness of the inner layer may be provided in several ways, for example, by choosing a material with a lower hardness (as indicated using any appropriate hardness scale, such as Shore A or Shore OO), by choosing a material with a lower elastic modulus, by choosing a material with a higher compressibility (typically quantified via a material's Poisson's ratio), and/or by modifying the structure of the softer material to contain a plurality of gas inclusions, such as a foam or an engraved structure, etc. For example, when the outer layer 222 includes a material having a hardness of 60 Shore A (as measured using ASTM D2240), the hardness of the inner layer 224 may be less than 60 Shore A. It should be noted that in some cases the hardness may be most appropriately measured using different scales for the inner and outer layers (e.g., Shore A durometer for the outer layer and Shore OO for the inner layer). In some embodiments, the compressibility of the inner layer 224 may be measured via Compression Force Deflection Testing per ASTM D3574 when the inner layer is foam; and via Compression-Deflection Testing per ASTM D1056 when the inner layer is a flexible cellular material such as, for example, sponge or expandable rubber.

In some embodiments, the inner layer 224 of the printing roll can have a compression force deflection of less than about 0.31 MPa (45 psi) at 25% deflection, optionally less than about 0.14 MPa (20 psi) at 25% deflection.

In some embodiments, the inner layer 224 of the printing roll can have a Poisson's ratio less than 0.4, or less than 0.3, and preferably less than 0.2.

In some embodiments, the thin outer shell 222 of the printing roll can have a hardness greater than about 40 Shore A, optionally greater than about 50 Shore A.

In some embodiments, the thin outer shell 222 can be made of a material with a Poisson's ratio greater than 0.2, greater than 0.3, and preferably greater than 0.4.

In some embodiments, the thin outer shell 222 of the printing roll can be made of a material with an elastic modulus of greater than 1.38 MPa (200 psi), greater than 2.07 MPa (300 psi), and preferably greater than 2.41 MPa (350 psi).

The printing roll 220 can be conveniently produced by physically mounting the thin outer shell 222 on top of the inner layer 224 which can be, for example, a soft foam. The outer shell 222 can be much "thinner" as compared to the diameter of the printing roll 220. In some embodiments, the ratio between the thickness of the outer shell 222 and the diameter of the printing roll 220 may be, for example, no greater than 1:20, no greater than 1:50, no greater than 1:80, no greater than 1:100, no greater than 1:200, or no greater than 1:500. The ratio may be, for example, no less than 1:20000, no less than 1:15000, no less than 1:5000, or no less than 1:2000. A useful range of the ratio may be, for example, from about 1:1000 to about 1:100. In some embodiments, the thin outer shell 222 may have a thickness of, for example, not greater than 5 mm, not greater than 3 mm, not greater than 2 mm, not greater than 1 mm, not greater than 0.8 mm, or not greater than 0.5 mm. The thickness of the thin outer shell 222 may be, for example, no less than 0.05 mm, no less than 0.08 mm, no less than 0.1 mm, or no less than 0.12 mm. A useful range of the outer shell thickness may be, for example, between about 0.1 mm and about 2.5 mm. In some embodiments, the diameter of the printing roll 220 may be, for example, no greater than 2000 mm, no greater than 1000 mm, no greater than 500 mm, or no greater than 300 mm. The diameter of the printing roll 220 may be, for example, no less than 10 mm, no less than 20 mm, no less than 50 mm, or no greater less than 100 mm. A useful range of the diameter may be, for example, between about 100 mm to about 250 mm.

The thin outer shell 222 can be removable from the inner layer 224. In some embodiments, the thin outer shell 222 may include multiple layers of materials that are laminated to an integral layer. For example, in one embodiment, the thin outer shell may have a layered structure of rubber-foam-rubber, which can removably encase the inner layer. In some embodiments, a thin elastic layer can be provided to encase the inner layer before removably mounting the thin outer shell thereon. The thin elastic layer may form an integral outer surface of the inner layer (e.g., a foam) to protect the inner layer when engaging/disengaging the thin outer shell.

Figure 2A:
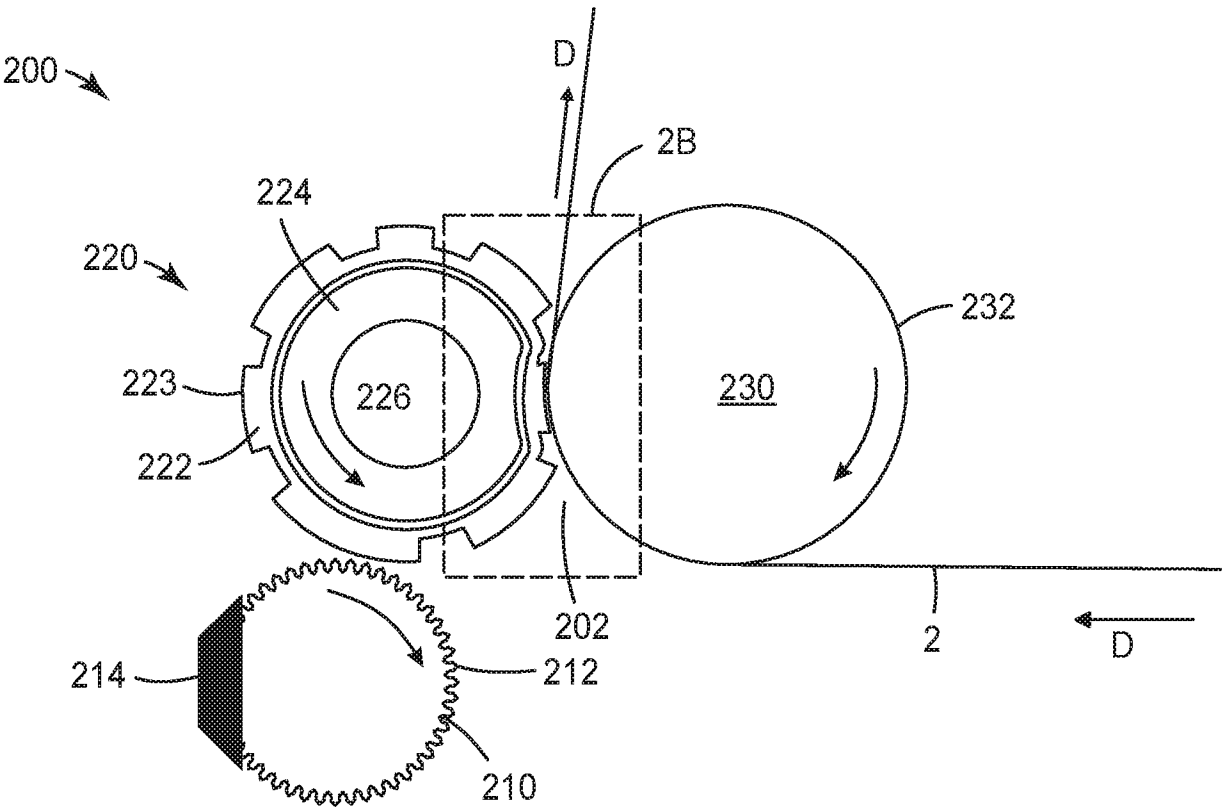
FIG. 2A is a schematic cross-sectional diagram of a printing system according to one embodiment of the present disclosure.
Figure 2B:
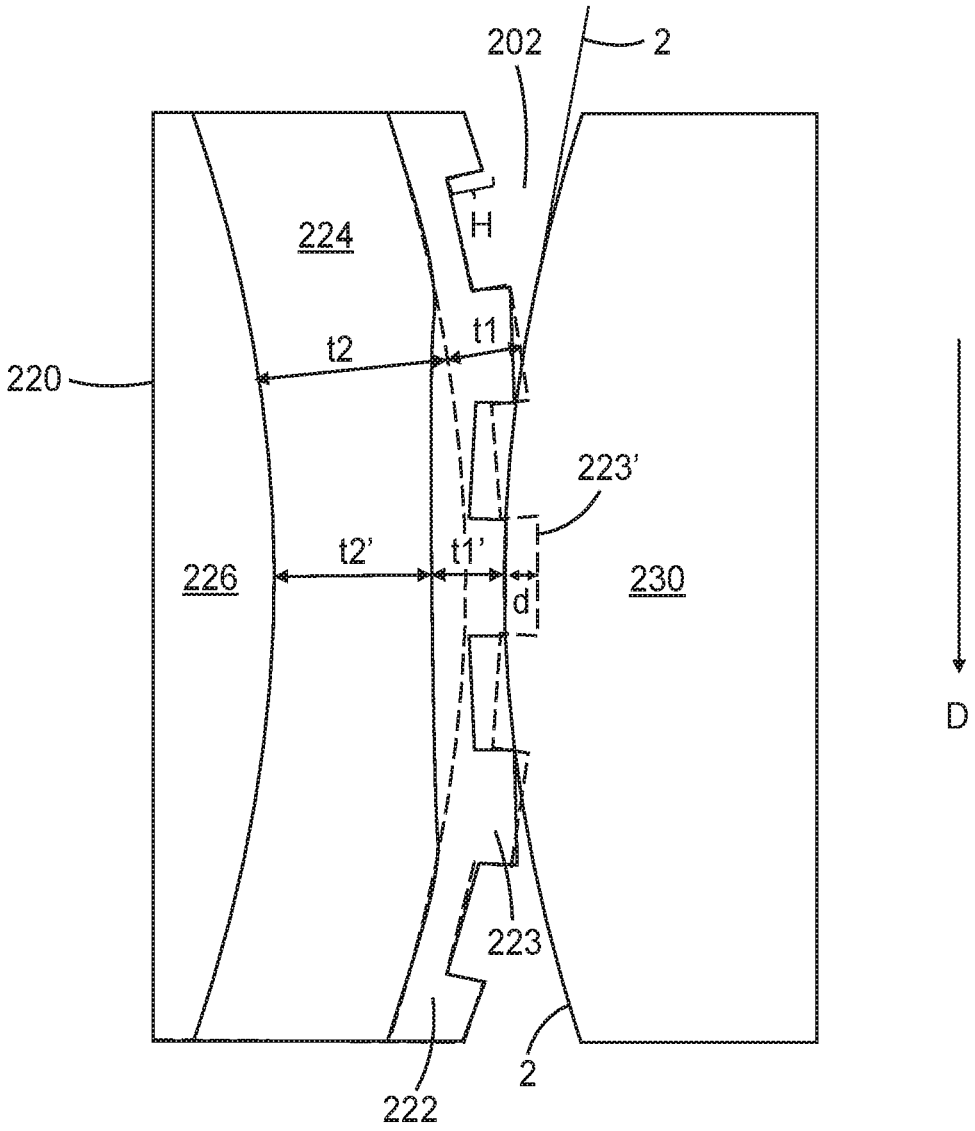
FIG. 2B is an enlarged portion view of the printing system of FIG. 2A, where ink is transferred from a printing roll onto a moving substrate.

Referring now to FIG. 2B, an enlarged portion view of the printing system 200 of FIG. 2A is shown. The enlarged view shows a portion of the printing roll 220 having the thin outer shell 222 and the thick compressible inner layer 224 mounted on the rigid central core 226; and a portion of the impression roll 230 positioned to press against the printing roll 220. The thin outer shell 222 includes a pattern of raised features 223 on a major surface thereof.

Before the printing roll 220 and the impression roll 230 contact and press against each other, the thin outer shell 222 has a thickness of t1, and the inner layer 224 has a thickness of t2. The thickness t1 is measured as the distance between the inner surface of the outer shell 222 and the top surface of the raised feature 223 when the outer shell 222 is under an undeformed state. The thickness t2 is measured as the distance between the opposite surfaces of the inner layer 224 when the inner layer 224 is under an undeformed state. The raised features 223 have a height H which is measured as the distance between the top surface of a raised feature and a bottom of that raised feature when the raised feature is under an undeformed state.

The thin outer shell 222 and the inner layer 224 have a thickness ratio t1/t2 in a range, for example, not greater than about 1, not greater than about 0.8, not greater than about 0.5, from about 0.01 to about 1, from about 0.03 to about 1, from about 0.05 to about 1, or from about 0.05 to about 0.5. In some embodiments, the thin outer shell has the thickness t1 in a range, for example, from about 0.76 mm (0.030 inch) to about 12.7 mm (0.50 inch), from about 1.02 mm (0.040 inch) to about 10.16 mm (0.40 inch), from about 1.27 mm (0.050 inch) to about 7.62 mm (0.30 inch), or from about 1.27 mm (0.050 inch) to about 3.175 mm (0.125 inch). In some embodiments, the compressible inner layer has the thickness t2 in a range, for example, from about 7.62 mm (0.30 inch) to about 76.2 mm (3.0 inch), from about 10.16 mm (0.40 inch) to about 63.5 mm (2.5 inch), from about 12.7 mm (0.50 inch) to about 50.8 mm (2.0 inch), or from about 12.7 mm (0.50 inch) to about 31.75 mm (1.25 inch). In some embodiments, the raised features may have the height H in a range, for example, about 0.25 mm (10 mils) to 2.54 mm (100 mils), or about 0.635 mm (25 mils) to 1.524 mm (60 mils).

As shown in FIG. 2A, the web 2 of indefinite length material is conveyed along the machine direction "D" through the nip 202 between the printing roll 220 and the impression roll 230. Under a certain impression force, the raised features 223 of the printing plate 222 contact the moving web 2 in the nip region 202, to allow transfer of ink material from the raised features 223 onto the moving web 2. In the depicted embodiment, the nip 202 is an impression between adjacent rolls 220 and 230 when the distance between the center of the rolls 220 and 230 is less than the sum of the undeformed radii of the two rolls 220 and 230, plus the thickness of the substrate. Regarding values or magnitudes of the nip or impression, the absolute difference between the above distance and sum can be, for example, about 0 micrometers, about 25 micrometers, about 100 micrometers, about 500 micrometers, about 1 mm, or any values therebetween. Each of the rolls 220 and 230 can be rotatably mounted on the respective shafts which can be in turn supported by structure omitted from the drawing for visual clarity.

Upon the impression between the printing roll 220 and the impression roll 230, the inner layer 224 can be elastically deformed and compressed in the nip 202, changing its thickness from t2 to t2', as shown in FIG. 2B. The outer shell 222 can deflect in unison with inner layer 224. The outer shell 222 is substantially less compressed compared to the inner layer 224. In some embodiments, the thickness change t1-t1' for the outer shell 222 may be, for example, less than 10%, less than 5%, or less than 3%.

A roll engagement depth d can be measured as the displacement of the outer surface of the outer shell of a printing roll from its undeformed state. It is to be understood that the rolls 220 and 230 can be positioned to produce a desired impression force therebetween. The roll engagement depth d may be in a range, for example, from 0 to 10 mm, from 0 to 5 mm, from 0 to 3 mm, or from 0 to 1.5 mm, etc., which may depend on the overall construction of the printing roll.

In the present disclosure, the inner layer 224 can be thick, elastically deformable, and with sufficient compressibility to accommodate the impression force while reducing the contact pressure such that even when the impression force applied between the printing roll 220 and the impression roll 230 varies within a certain range of values, the raised features 223 on the outer shell 222 can remain substantially undeformed, avoiding a sliding motion on the moving web 2 and/or a significant growth of printing feature on the web 2. See FIG. 2B, for example, even when the raised features 223 change from their previous position shown by a dotted line 223' upon the impression, there is no noticeable deformation of the raised features 223 that may induce a significant growth of printing feature on the web 2. Also, the thick, elastically-deformable and compressible inner layer can accommodate the impression such that the relative slide of the raised features 223 on the moving web can be significantly reduced, in particular when the web enters and exits the nip 202. This can effectively prevent the formation of ghosting or smearing defects as observed in a conventional flexographic printing system.

Figure 2C:
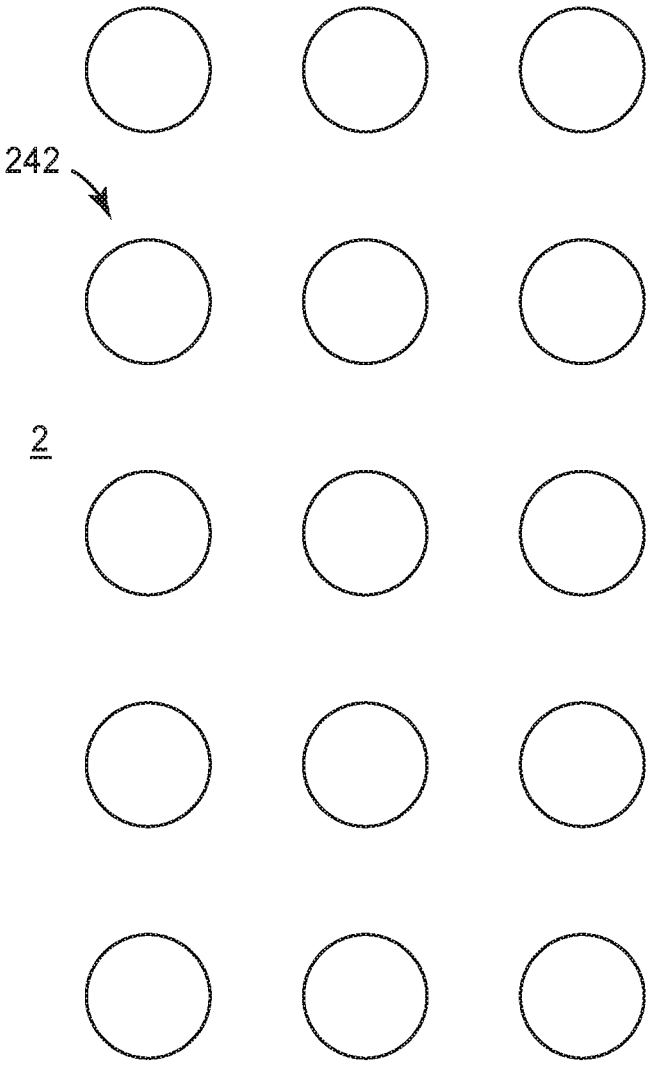
FIG. 2C illustrates a pattern of printed features on the web without noticeable ghosting or smearing defects.

While not wanting to be bound by theory, it is believed that because the inner layer 224 is thick and deformable enough to accommodate the deformation of the printing plate 222 induced by the impression force, in particular, the deformation in the radial direction, the raised features 223 of the printing plate 222 can remain undeformed and/or not slide on the moving web 2, avoiding a growth of printing features thereon. As illustrated in FIG. 2C, a pattern of features 242 is printed onto the moving web 2 when pressing the printing roll 220 and the impression roll 230 against each other to transfer the ink material from the raised features 223 to the web 2. In contrast to the growth of the printed features 142 in FIG. 1C, the printed features 242 have no noticeable growth and have a size and shape substantially the same as designed.

Figure 3A:
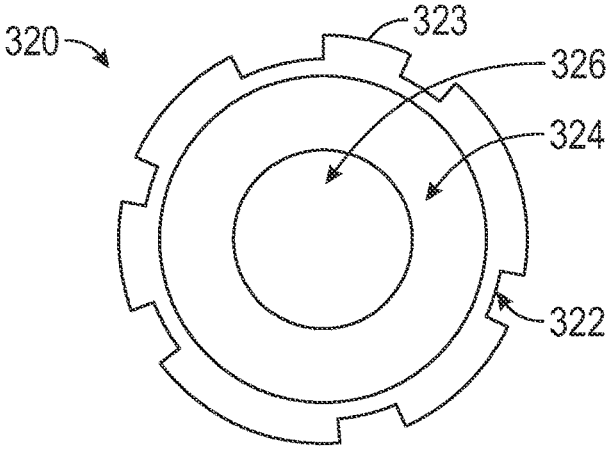
FIG. 3A is a schematic side view of the printing roll of FIG. 2A, according to one embodiment.

The printing roll 220 can have various configurations including a thin outer shell having a pattern of raised features thereon and an elastically deformable and compressible inner layer which is softer and thicker than the thin outer shell. FIG. 3A is a cross-sectional view of an exemplary printing roll 320, according to one embodiment. The printing roll 320 includes a compressible inner layer 324 mounted on a rigid core 326. A thin outer shell 322 encases the inner layer 324. In the depicted embodiment of FIG. 3A, the inner layer 324 is made of a soft foam; the thin outer shell 322 is a deformable layer (e.g., a rubber sleeve, a photopolymer, etc.) having an engraved pattern 323 thereon.

Figure 3B:
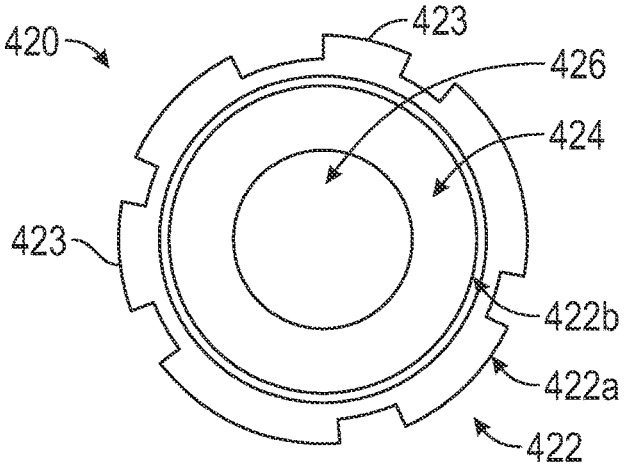
FIG. 3B is a schematic side view of the printing roll of FIG. 2A, according to another embodiment.

FIG. 3B is a cross-sectional view of an exemplary printing roll 420, according to another embodiment. The printing roll 420 includes an inner layer 424 mounted on a rigid core 426. A thin outer shell 422 encases the inner layer 424. The thin outer shell 422 includes a printing pattern layer 422*a* having a pattern of features 423 thereon and a thin elastic layer 422*b* disposed between the printing pattern layer 422*a* and the inner layer 424. In the depicted embodiment of FIG. 3B, the inner layer 424 is made of a soft foam. The thin elastic layer 422*b* is made of a rubber to encase the soft foam such that the printing pattern layer 422*a* can be removed from the printing roll 220 without damaging the inner layer 424. In some embodiments, the thin elastic layer 422*b* can be permanently adhered to the inner layer 424.

Figure 3C:
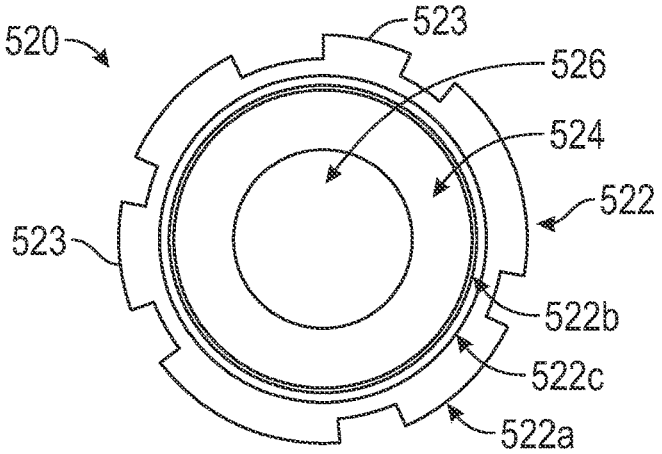
FIG. 3C is a schematic side view of the printing roll of FIG. 2A, according to another embodiment.

FIG. 3C is a cross-sectional view of an exemplary printing roll 520, according to another embodiment. The printing roll 520 includes an inner layer 524 mounted on a rigid core 526. A thin outer shell 522 encases the inner layer 524. The thin outer shell 522 includes a printing pattern layer 522*a* having a pattern of features 523 thereon, a thin elastic layer 522*b*, and a removable thin foam layer 522*c* disposed between the printing pattern layer 522*a* and the thin elastic layer 522*b*. In the depicted embodiment of FIG. 3C, the inner layer 524 is made of a soft foam. The thin elastic layer 522*b* is made of a rubber to encase the soft foam such that the printing pattern layer 422*a* along with the removable thin foam layer 522*c* can be removed from the printing roll 220 without damaging the inner layer 524. In some embodiments, the thin elastic layer 522*b* can be permanently adhered to the inner layer 524.

The operation of the present disclosure will be further described with regard to the following embodiments directed to printing systems and methods. These embodiments are offered to further illustrate the various specific and preferred embodiments and techniques. It should be understood, however, that many variations and modifications may be made while remaining within the scope of the present disclosure.

Listing of Exemplary Embodiments

Exemplary embodiments are listed below. It is to be understood that any one of the embodiments 1-7 and 8-21 can be combined.

Embodiment 1 is a method of printing a pattern of features onto a web, the method comprising:
- providing a printing roll comprising:
  - an elastically deformable and compressible inner layer and a thin outer shell to cover the inner layer, wherein the thin outer shell includes a pattern of raised print features to receive ink material thereon, the inner layer is softer and thicker than the thin outer shell;
- supplying a liquid ink onto the pattern of raised print features of the printing roll; and
- applying an impression force to press the printing roll and the web against each other to transfer the liquid ink from the printing roll to the web to form the pattern of features.

Embodiment 2 is the method of embodiment 1, wherein the thin outer shell and the inner layer have a thickness ratio not greater than about 0.5.

Embodiment 3 is the method of embodiment 1 or, further comprising providing an impression roll adjacent to the printing roll to form a nip.

Embodiment 4 is the method of embodiment 3, further comprising advancing the web along a machine direction through the nip.

Embodiment 5 is the method of embodiment 3 or 4, wherein the inner layer of the printing roll has a thickness, a compression force deflection value, and an elastically-deformable compressibility such that when the printing roll and the impression roll are pressed against each other with a roll engagement depth in a range from about 0 to 1.5 mm, the raised print features do not slide or deform with respect to the web in an amount to generate a substantially visible dot gain.

Embodiment 6 is the method of any one of embodiments 1-5, wherein the printing roll is pressed with an impression in a range from about 0.0254 to 0.508 mm (1 to 20 mils) with respect to a printing "zero" impression.

Embodiment 7 is the method of any one of embodiments 1-6, further comprising providing an inking roll, wherein the liquid ink is transferred from the inking roll to the printing roll.

Embodiment 8 is a printing system comprising:
- a printing roll comprising an elastically deformable and compressible inner layer and a thin outer shell to cover the inner layer, wherein the thin outer shell includes a pattern of raised print features to receive ink material thereon, the inner layer is softer and thicker than the thin outer shell, and the thin outer shell and the inner layer have a thickness ratio not greater than about 0.5;
- an impression roll positioned adjacent to the printing roll, and a nip formed between the printing roll and the impression roll; and
- a flexible web being advanced along the machine direction through the nip.

Embodiment 9 is a printing system comprising:
- a printing roll comprising:
  - an elastically deformable and compressible inner layer; and
  - a thin outer shell to cover the inner layer,
  - wherein the thin outer shell includes a pattern of raised print features to receive ink material thereon, the inner layer is softer and thicker than the thin outer shell, and the thin outer shell and the inner layer have a thickness ratio not greater than about 0.5.

Embodiment 10 is the printing system of embodiment 8, wherein the inner layer of the printing roll has a thickness, a compression force deflection value, and an elastically-deformable compressibility such that when the printing roll and the impression roll are pressed against each other with a roll engagement depth in a range from about 0 to 1.5 mm, the raised print features do not slide or deform with respect to the web in an amount to generate a substantially visible dot gain.

Embodiment 11 is the printing system of any one of embodiments 8-10, wherein the inner layer of the printing roll has a compression force deflection of less than about 0.32 MPa (45 psi) at 25% deflection, optionally less than about 0.14 MPa (20 psi) at 25% deflection.

Embodiment 12 is the printing system of any one of embodiments 8-11, wherein the thin outer shell of the printing roll has a hardness greater than about 40 Shore A, optionally greater than about 50 Shore A.

Embodiment 13 is the printing system of any one of embodiments 8-12, wherein the inner layer of the printing roll has a Poison's ratio less than 0.4, or less than 0.3, and preferably less than 0.2.

Embodiment 14 is the printing system of any one of embodiments 8-13, wherein the thin outer shell made of a material with a Poison's ratio greater than 0.2, greater than 0.3, and preferably greater than 0.4.

Embodiment 15 is the printing system of any one of embodiments 8-14, wherein the outer shell of the printing roll made of a material with an elastic modulus of greater than 1.38 MPa (200 psi), greater than 2.07 MPa (300 psi), and preferably greater than 2.41 MPa (350 psi).

Embodiment 16 is the printing system of any one of embodiments 8-15, wherein the inner layer has a thickness in a range from about 3.18 mm (0.125 inch)' to about 31.75 mm (1.25 inch).

Embodiment 17 is the printing system of any one of embodiments 8-16, wherein the thin outer shell has a thickness in a range from about 1.52 mm (0.030 inch) to about 6.35 mm (0.250 inch).

Embodiment 18 is the printing system of any one of embodiments 8-17, wherein the thin outer shell includes one or more materials of an elastomer, a metal, a fabric, or a nonwoven.

Embodiment 19 is the printing system of any one of embodiments 8-18, wherein the inner layer includes one or more materials of a synthetic foam, an engraved, structured, 3D printed, or embossed elastomer, a fabric or nonwoven layer, a plurality of cavities filled with gas of a controlled pressure, or a soft rubber.

Embodiment 20 is the printing system of any one of embodiments 8-19, wherein the thin outer shell is removable from the inner layer.

Embodiment 21 is the printing system of any one of embodiments 8-20, wherein the printing roll has an S-Factor, averaged over a range of a roll engagement depth from about 0.05 mm to about 1 mm, optionally being less than about 5 ($10^6 \cdot N/m^{5/2}$), less than about 3 ($10^6 \cdot N/m^{5/2}$), or less than about 1 ($10^6 \cdot N/m^{5/2}$).

Reference throughout this specification to "select embodiments", "certain embodiments", "some embodiments", or "an embodiment", whether or not including the term "exemplary" preceding the term "embodiment", means that a particular feature, structure, material, or characteristic described in connection with the embodiment is included in at least one embodiment of the certain exemplary embodiments of the present disclosure. Thus, the appearances of these phrases in various places throughout this specification are not necessarily referring to the same embodiment of the certain exemplary embodiments of the present disclosure. Furthermore, the particular features, structures, materials, or characteristics may be combined in any suitable manner in one or more embodiments.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

EXAMPLES

These Examples are merely for illustrative purposes and are not meant to be overly limiting on the scope of the appended claims. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Example 1

A printing roll was constructed including a thick foam layer covered by a thin engraved rubber sleeve, mounted on a metal core. The configuration of the printing roll was like the one shown in FIG. 3A. The printing roll was 121.92 mm (4.8 inch) in total diameter with the foam layer thickness of 9.53 mm (0.375 inch) on a steel roll core. A pattern of print features was engraved into the outer surface (skin) of the thin rubber sleeve. The print features stood about 0.71 mm (0.028 inch) out of the surrounding rubber. The thin engraved rubber sleeve was about 1.65 mm (0.065 inch) thick, measured as the distance between the inner surface of the sleeve and the top surface of the print feature. The thickness ratio of rubber to foam for this construction was calculated to be about 0.17 (1.65/9.53=0.17).

The foam layer of the printing roll was a polyurethane commercially available from American Roller under the trade designation Pegasus™ PN 210 with a compression force deflection of about 0.02 MPa (3 psi) at 25% compression-deflection. The rubber skin was a laser-engravable ethylene propylene diene monomer (EPDM) rubber with features engraved at 2400 ppi. The pattern engraved into the roll was an array of squares divided into smaller squares of different lengths and spacings. The rubber sleeve was not adhered to the foam layer. Instead, the rubber sleeve remained in place due to a slight compression fit over the underneath foam layer, making the rubber sleeve completely removable from the foam layer and easily replaceable.

Example 2

A printing roll was constructed including a thick foam layer covered by a thin engraved rubber sleeve, mounted on a metal core. The configuration of the printing roll was like the one shown in FIG. 3C. A 142.5 mm (5.612") diameter roller with a 106.0 mm (4.172") metal core covered by a 15.2 mm (0.6") thick polyurethane foam and a 3.05 mm (0.12") thick urethane rubber layer, commercially available from American Roller under the trade designation Pegasus PN 711 was covered by a layer of 1.52 mm (0.060 inch) thick 3M Cushion-Mount Plus Plate Mounting Tape 1060 commercially available from 3M Company (Saint Paul, MN, USA). A photopolymer printing plate with a total thickness of 1.70 mm (0.067") and imaged with a pattern of 830 micrometer square features on a 1410 micrometer pitch with a feature height of approximately 0.86 mm (0.034") was mounted over the plate mounting tape to form the final printing roll construction with an outer diameter of 149.0 mm (5.866").

Example 3

A printing roll was constructed including a thick foam layer covered by a thin engraved rubber sleeve, mounted on a metal core. The configuration of the printing roll was like the one shown in FIG. 3C. A 142.5 mm (5.612") diameter Pegasus roller with a 106 mm (4.172") metal core covered by a 15.2 mm (0.6") thick polyurethane foam and a 3.05 mm (0.12") thick urethane rubber layer, commercially available from American Roller under the trade designation Pegasus PN 711 was covered by a layer of 0.51 mm (0.020 inch) thick 3M Cushion-Mount Plus Plate Mounting Tape E1820 commercially available from 3M Company (Saint Paul, MN, USA). A photopolymer printing plate with a total thickness of 1.70 mm (0.067") and imaged with a pattern of 830 micrometer square features on a 1410 micrometer pitch with a feature height of approximately 0.86 mm (0.034") was mounted over the plate mounting tape to form the final printing roll construction with an outer diameter of 147 mm (5.786").

Comparative Example 1

For comparison, a traditional flexographic printing roll was constructed including a 1.70 mm (0.067 inch) thick photopolymer printing plate with the same print features as Example 1. The plate was mounted onto a 90.2 mm (3.55") diameter steel plate roll with 0.51 mm (0.020 inch) thick 3M Cushion-Mount Plus Plate Mounting Tape E1820 commercially available from 3M Company (Saint Paul, MN, USA). The configuration of the traditional printing roll was like the one shown in FIG. 1A.

Comparative Example 2

For comparison, a traditional flexographic printing roll was constructed including a 1.70 mm (0.067 inch) thick photopolymer printing plate with the same print features as Examples 2 and 3. The plate was mounted onto a 106 mm (4.172") diameter steel roll with 1.52 mm (0.060 inch) thick 3M Cushion-Mount Plus Plate Mounting Tape commercially available from 3M Company (Saint Paul, MN, USA). The configuration of the traditional printing roll was like the one shown in FIG. 1A.

Comparative Example 3

For comparison, a traditional flexographic printing roll was constructed including a 1.70 mm (0.067 inch) thick photopolymer printing plate with the same print features as Examples 2 and 3 and Comparative Example 2. The plate was mounted onto a 106 mm (4.172") diameter steel roll with 0.51 mm (0.020 inch) thick 3M Cushion-Mount Plus Plate Mounting Tape E1820 commercially available from 3M Company (Saint Paul, MN, USA). The configuration of the traditional printing roll was like the one shown in FIG. 1A.

Analysis of Print Performance

The printing rolls described in the Examples and Comparative Examples above were respectively used as a plate roll in a printing trial on a coating line using a printing ink and 2 mil thick PET. The printing inks used were commercially available from Nazdar Ink Technologies (Shawnee, KS) under the trade designations Nazdar 9413 Base Warm Red (BW5), Nazdar 9323 FR Warm Red/Rojo (BW7), and Nazdar OP1028 high gloss UV coating.

The printing rolls of Example 1 and Comparative Example 1 were used to print at line speeds ranging from 3.05-15.2 meters per minutes (10-50 feet per minute) and at impressions of 0-0.76 mm (0-0.03 inches). The impression roll was a 90 mm diameter steel roll, and the inking roll was a 120 mm diameter anilox roll, laser engraved in ceramic at 5 BCM (billion cubic microns per square inch) and 600 lpi. Nazdar 9413 was fed to the anilox roll via a pan beneath the roll, and any excess solution was removed with a 50.8 mm (2 inch) Esterlam doctor blade, mounted in a doctor blade holder, that was engaged against the anilox roll using a 2.27 kg (5 lb) weight. The fixture used a weight to apply the blade force.

The printing rolls of Examples 2 and 3 and Comparative Examples 2 and 3 were used to print at line speeds ranging from 10 to 100 feet per minute and at impressions of 0-0.76 mm (0-0.03 inches). The impression roll was 151.8 mm (5.975") diameter and the inking roll was a 129.6 mm (5.101") diameter anilox roll, laser engraved in ceramic at 6 BCM and 400 lpi. Either Nazdar 9323 FR Warm Red/Rojo (BW7), and Nazdar OP1028 high gloss UV coating was fed to the anilox roll via a 152.4 mm (6") enclosed feed applicator that was pressed against the anilox roll and bladed off via a metal doctor blade.

For all Examples upon startup, the anilox roll was first brought into contact with the printing plate roll until the ink on the anilox roll appeared to be transferring to the entire pattern on the plate roll. Next the impression roll was slowly brought into contact with the plate roll until a point was reached where the entire pattern on the plate roll had just begun to transfer to the substrate. The impression was zeroed at this point and further adjustments were made in reference to this zero point (i.e., a printing "zero" impression). In some cases, an impression between the rolls can be measured with respect to this zero point.

Overall print quality was judged both by observing the presence or absence of print defects and by comparing the resulting print dimensions to those on the original pattern. Analysis of the quality of the prints and the dimensions of the square arrays was done through microscope imaging and optical measurements of representative samples, as seen in the images of FIG. 4.

Figure 4:
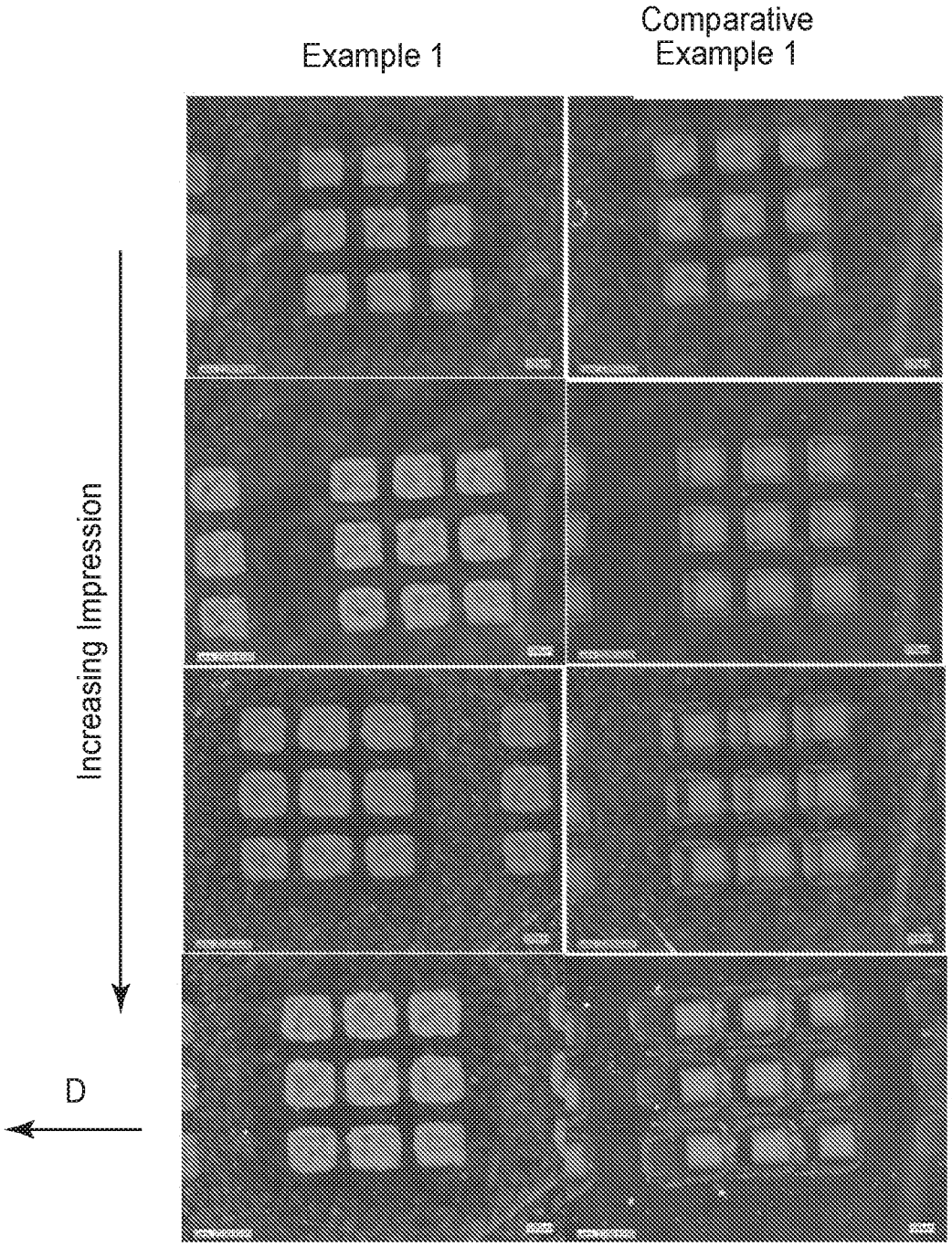
FIG. 4 is an image of a first set of printed ink patterns prepared according to Example 1 under different impressions, and a second set of printed ink patterns prepared according to Comparative Example 1 under different impressions.

As shown in the images of FIG. 4, prints produced by the printing roll of Example 1 showed none of the "ghosting" or "smearing" defects which are apparent at higher impressions in the prints produced by the printing roll of Comparative Example 1. Ghosting can be characterized by the presence of a significant amount of ink outside of the shape of the intended print feature. The respective roll impressions measured with respect to a printing "zero" impression, are 0, 10, 20 and 30 mils from top to bottom.

Figure 5:
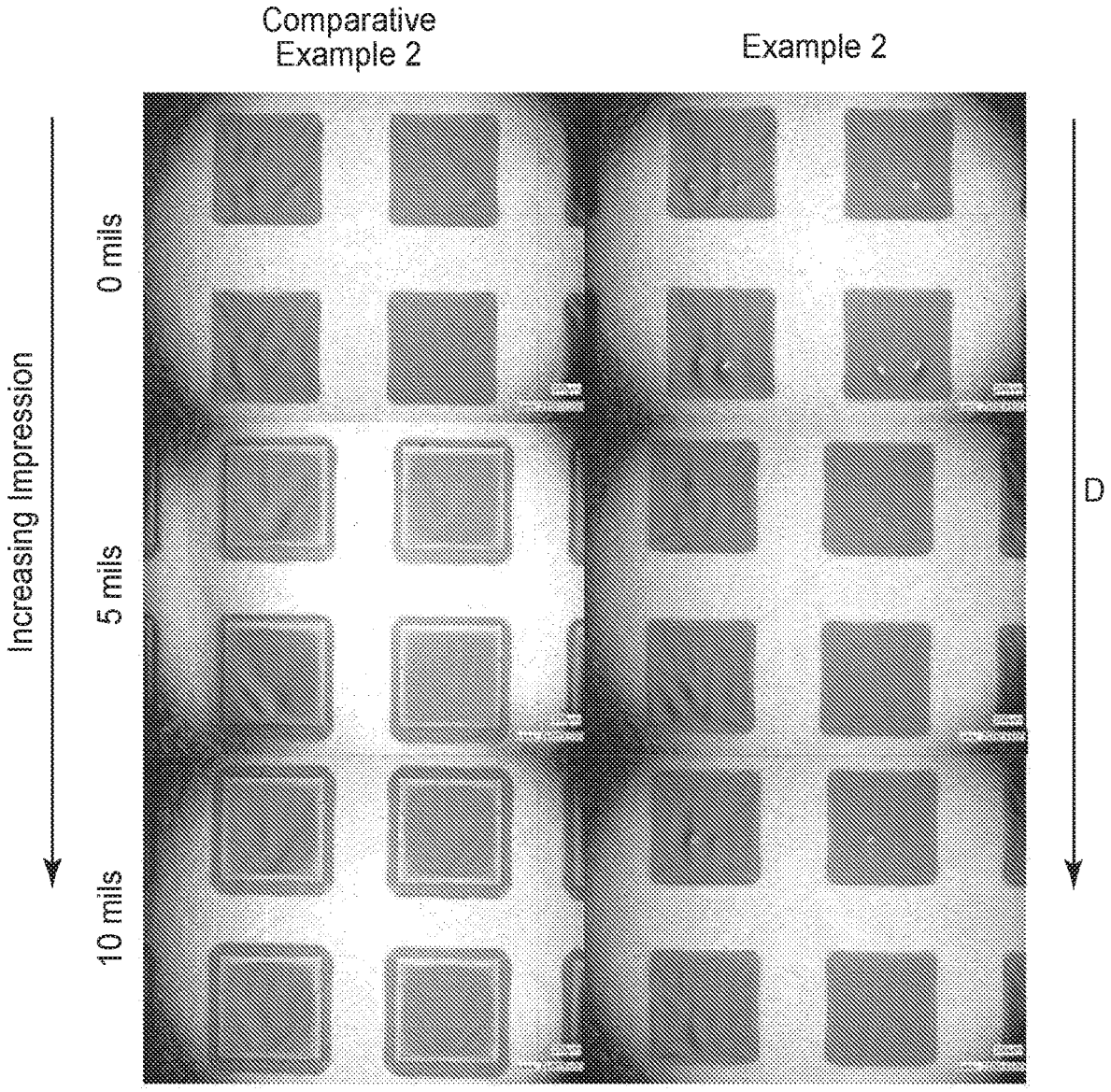
FIG. 5 is an image of a first set of printed ink patterns prepared according to Example 2 under different impressions, and a second set of printed ink patterns prepared according to Comparative Example 2 under different impressions.

As shown in the images of FIG. 5, prints produced by the printing roll of Example 2 show none of the "ring" defects which are apparent at higher impressions in the prints produced by the printing roll of Comparative Example 2. Similar to "ghosting" and "smearing" defects, a "ring" defect is also characterized by the presence of a significant amount of ink outside of the shape of the intended print feature, often forming a uniform "ring" of material framing the intended print feature.

Figure 6A:
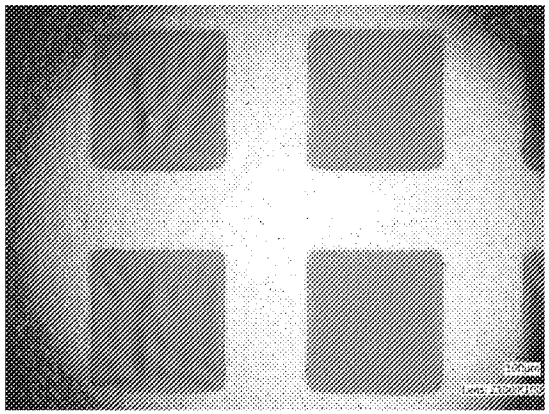
FIG. 6A is an image of a printed ink patterns prepared according to Example 3.
Figure 6B:
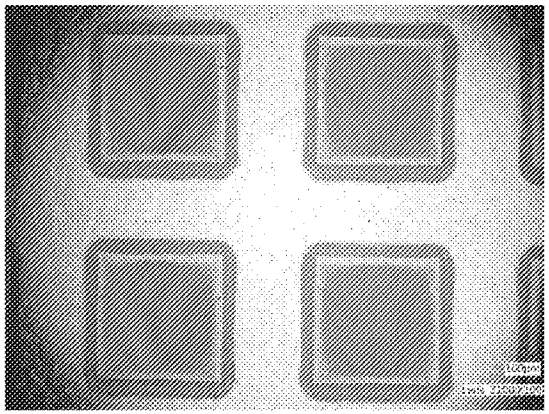
FIG. 6B is an image of a printed ink patterns prepared according to Comparative Example 2.
Figure 6C:
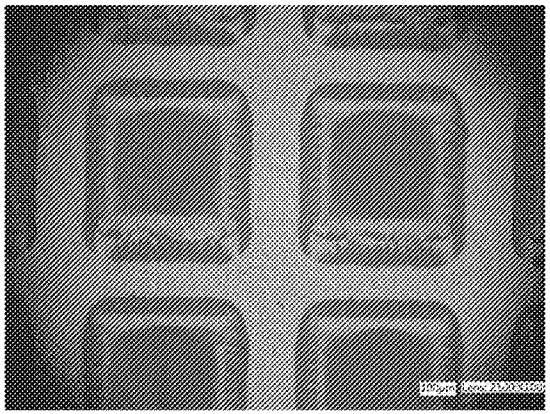
FIG. 6C is an image of a printed ink patterns prepared according to Comparative Example 3.

FIGS. 6A, 6B, and 6C illustrate images taken of prints which were formed by the printing rolls of Example 3, Comparative Example 2, and Comparative Example 3 all at the same impression of 0.254 mm (10 mils) beyond the "zero" impression. As shown in FIG. 6A, prints produced by the printing roll in Example 3 at 0.254 mm (10 mils) impression are still substantially square in shape, and are only approximately 8% longer (in the down-web direction) and 7% wider (in the cross-web direction) than the imaged feature on the printing plate and show no additional ink outside of the intended print feature in the form of a "ring" or other print defect. In FIG. 6B, prints produced by the printing roll in Comparative Example 2 with a 1.524 mm (60 mil) thick foam show clear "ring" defects and are 22% longer and 19% wider than the imaged feature on the printing plate. Further, in FIG. 6C, prints produced by the printing roll in Comparative Example 3, which has a 0.508 mm (20 mils) thick foam common in industry, at 0.254 mm (10 mils) impression show gross "ring" defects and are 40% longer and 30% wider than the imaged feature on the printing plate.

Mechanical Impression Testing of Printing Rollers

Figure 7:
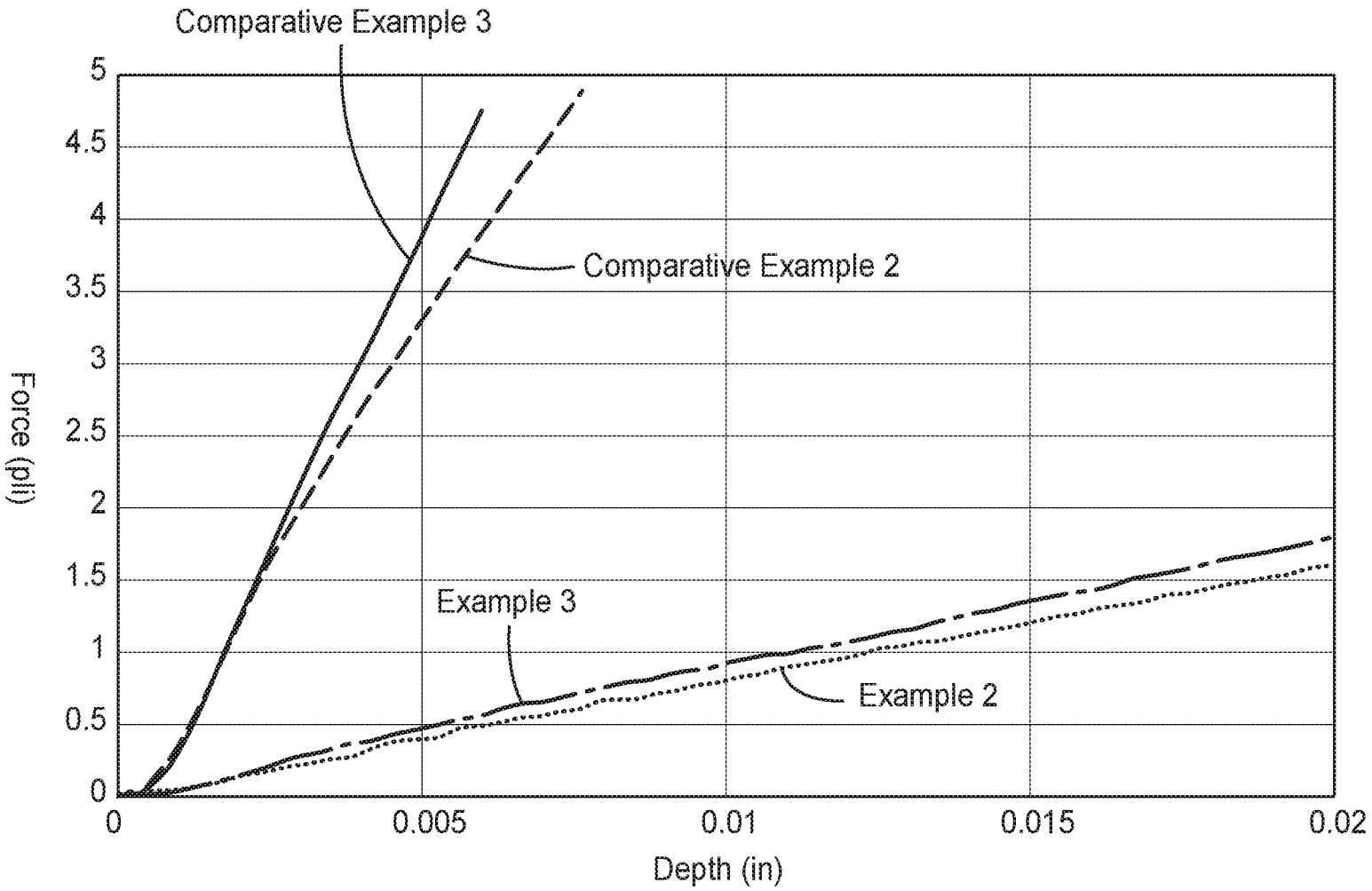
FIG. 7 illustrates plots of engagement force (pli) versus roll engagement depth (inch) according to Examples 2 and 3 and Comparative Examples 2 and 3.

Mechanical impression testing using an Instron (Model 5500R) universal mechanical testing machine manufactured by Instron Corporation was conducted for Examples 2-3 and Comparative Examples 2-3. The mechanical impression testing method was described in U.S. Patent Application No. 62/589,249, which is incorporated herein by reference. The general procedure that was followed was to configure the mechanical testing machine with a steel test roller having an outside diameter of 90 mm positioned directly above the deformable printing roller whose properties are to be measured, with the two rolls aligned such that their central axes were parallel. The test roller was engaged into each deformable printing roller over a range of roll engagement depths at a constant speed of about 83.8 micrometers per second. The roll engagement depth and the contact force between the test roller and the deformable printing roller was measured and recorded using the Instron's frame position sensor and force load cell. The measured force was then divided by the length of contact between the two rolls along the central axes of the rolls (as defined by distal ends of the printing pattern features), to generate a force corrected for length. The corrected force in units of pli was plotted versus impression for each test. Representative force versus impression curves for Examples 2-3 and Comparative Examples 2-3 are shown in FIG. 7. Examples 2-3 exhibit significantly lower contact force at each impression value compared to Comparative Examples 2-3.

S-Factor Determination

The S-factor was determined using the general procedure described in WO 2019/102295 (Meyers et al.), which is incorporated herein by reference. The S-factor may be calculated at each point on a force vs. displacement curve, such as those outlined in the procedure for mechanical impression testing in the previous section and shown in FIG. 7, by applying Equation [1]:

$$S = \frac{F}{d\sqrt{R_E}}, \quad [1]$$

where S represents the S-factor value, d represents the roll engagement depth, F represents the applied force normalized to a unit length of roller contact along the central axis, and $R_E$ represents the effective radius given by $$R_E = \frac{D_1 D_2}{2(D_1 + D_2)}, \quad [2]$$

where $D_1$ and $D_2$ represent the outside diameters of the two rollers used during mechanical impression testing (i.e. the test roller and the deformable printing roller). The calculation in Equation [1] is carried out individually for each data pair ($F_i$, $d_i$) obtained from the mechanical compression test described in the previous section to obtain S-factors at each point.

S-factors can be used to quantitatively describe intrinsic design properties of deformable rollers. A detailed discussion of S-factor can be found in U.S. Patent Application No. 62/779,138 (Dodds et al.), which is incorporated herein by reference. S-factors are impacted by the thickness, modulus, and Poisson's ratio or compressibility of the various layers covering the rigid core of the deformable roller. By dividing the normalized force data obtained via mechanical impression testing by the square root of the effective radius we render the force displacement data into a geometrically invariant form, and so S-factors do not depend significantly on the lengths or diameters of the rollers in contact with each other. It may be noted that the S-factor is related to the slope of the normalized force data, having the same units of measure, namely $N/m^{5/2}$. However, it should be clarified that S-factor is not a true local slope because it depends on the magnitude of the corrected force datum $F_i$ and total engagement value $d_i$ used to obtain that force, and not on the local rate of change of the force with respect to the impression.

By applying Equation [1] to the mechanical testing data shown in FIG. 7, S-factor curves can be generated for the printing rollers described in Examples 2-3 and Comparative Examples 2-3.

It is to be understood that in some embodiments, the S-factors can be averaged over a range of engagement d from 0.05 mm to 1 mm without significantly changing the result. It is important to note that there may be an upper engagement limit for some deformable roll constructions. Two non-limiting examples of why one would need to set an upper engagement limit could be if the force generated exceeds the capacity of the load cell in the mechanical testing apparatus, or if the inner or outer layers exceed their yield stress. When calculating the slope of the S-factor it is to be understood that the range of engagement values used falls below an upper engagement limit wherein a compressible inner layer has been compressed beyond its design limit. The average S-factor can be calculated by averaging S-factor data pairs ($S_i$, $d_i$) for all engagement values $d_i$, typically between 0 mm and 1 mm. When this method is applied to the S-factor data generated from mechanical impression testing of the printing rollers described in Examples 2 and 3, and Comparative Examples 2 and 3, we obtain average S-factor values of $0.65\times10^6$ $N/m^{5/2}$ for Example 2, $0.51\times10^6$ $N/m^{5/2}$ for Example 3, $4.5\times10^6$ $N/m^{5/2}$ for Comparative Example 2, and $5.9\times10^6$ $N/m^{5/2}$ for Comparative Example 3. In the present disclosure, a printing roll may have an S-factor, averaged over a range of a roll engagement depth from about 0.05 mm to about 1 mm, optionally being less than about 5 ($10^6 \cdot N/m^{5/2}$), less than about 3 ($10^6 \cdot N/m^{5/2}$), less than about 2 ($10^6 \cdot m^{5/2}$), less than about 1.5 ($10^6 \cdot N/m^{5/2}$), or less than about 1 ($10^6 \cdot N/m^{5/2}$).

Determination of S-Factor at Relevant Printing Impressions Via Footprint

Footprints were taken at a number of impressions (based off the relative "zero" printing impression described above) for the rollers described in Examples 2-3 and Comparative Examples 2-3, and the corresponding roll engagement depths were calculated. The footprints were generated by engaging the inked plate roll at a given value of impression with the web and impression roll in a flexographic printing press, while the web and rolls were stationary. The ink from the plate roll transferred to the web only in the areas where the plate roll and web were in contact, and the resulting ink footprint was then solidified using UV light. The downweb length of the footprint was measured using a micrometer, giving us a measurement of the contact length (in the downweb direction) between the plate roll and web at each impression. A plot of printing impression vs. footprint length was then produced, and the data was fit to a third-order polynomial using least squares regression. As the "zero" impression defined earlier for printing is not necessarily the point at which the two rolls initiate contact, the third-order polynomial was used to extrapolate to the true zero point—i.e. the engagement at which the printing roll and web just begin to touch, and where there would be no substantial footprint measured. Once this true zero point is known for each printing roll, the actual roll engagement depth d at each printing impression can be determined by simply adding the coefficient of the zeroth degree term in the polynomial to the printing impression value.

The roller engagement values can then be used to estimate the S-factor values at various printing impressions by referencing the S-factor vs engagement curve obtained in the previous section. This was performed for the printing rolls described in Examples 2-3 and Comparative Examples 2-3. Once S-factor values were determined for each roll at each impression value, this 5-factor value can be compared against the downweb or crossweb dot gain observed for that particular printing condition, as seen in Table 1. Table 1 highlights that the printing conditions described in Comparative Examples 2 and 3 (which would be considered "typical" in the printing industry) have S-factors of approximately $5\times10^6$ $N/m^{5/2}$ or greater over the range of impression values observed during printing. By comparison, Examples 2 and 3 have S-factors that are approximately an order of magnitude lower, about $0.5\times10^6$ $N/m^{5/2}$. Additionally, it can be seen that the crossweb and downweb feature ratios for Comparative Examples 2 and 3 grow significantly over the range of impression studied, while these ratios remain very close to 1 for Examples 2 and 3—i.e. significantly less dot gain is observed in Examples 2 and 3 than in Comparative Examples 2 and 3, with the significant difference in the S-factor providing some explanation for this result.

TABLE 1

| Roller | Printing Impression mm (in) | Measured Footprint mm (in) | Calculated Roll Engagement depth mm (in) | S-factor at Calculated Roller Engagement × $10^6$ $N/m^{5/2}$ | Downweb Feature Ratio | Crossweb Feature Ratio |
|---|---|---|---|---|---|---|
| Comparative Example 2 | 0.00 (0.000) | 3.3 (0.13) | 0.178 (0.007) | 4.861 | 1.04 | 1.03 |
| Comparative Example 2 | 0.12 (0.005) | 6.6 (0.26) | 0.305 (0.012) | 5.075 | 1.17 | 1.13 |
| Comparative Example 2 | 0.25 (0.010) | 9.4 (0.37) | 0.406 (0.016) | 4.999 | 1.22 | 1.19 |
| Comparative Example 3 | 0.00 (0.000) | 4.5 (0.18) | 0.330 (0.013) | 6.405 | 1.10 | 1.12 |
| Comparative Example 3 | 0.12 (0.005) | 7.4 (0.29) | 0.432 (0.017) | 6.653 | 1.23 | 1.16 |
| Comparative Example 3 | 0.25 (0.010) | 9.4 (0.37) | 0.556 (0.022) | 6.852 | 1.40 | 1.30 |
| Example 2 | 0.00 (0.000) | 2.8 (0.11) | 1.143 (0.045) | 0.626 | 1.06 | 1.04 |
| Example 2 | 0.12 (0.005) | 3.5 (0.14) | 1.245 (0.049) | 0.628 | 1.08 | 1.07 |
| Example 2 | 0.25 (0.010) | 3.8 (0.15) | 1.346 (0.053) | 0.627 | 1.08 | 1.07 |
| Example 3 | 0.00 (0.000) | 2.5 (0.10) | 0.254 (0.010) | 0.508 | 1.05 | 1.03 |
| Example 3 | 0.12 (0.005) | 3.0 (0.12) | 0.381 (0.015) | 0.531 | 1.08 | 1.06 |
| Example 3 | 0.25 (0.010) | 4.6 (0.18) | 0.4826 (0.019) | 0.54 | 1.09 | 1.06 |

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g., 1 to 5 includes 1, 1.5, 2, 2.75, 3, 3.80, 4, and 5). In addition, all numbers used herein are assumed to be modified by the term "about." Various exemplary embodiments have been described. These and other embodiments are within the scope of the following claims.

What is claimed is:

1. A method of printing a pattern of features onto a web, the method comprising:

providing a printing roll comprising:

an elastically deformable and compressible inner layer and a thin outer shell to cover the inner layer, wherein the thin outer shell includes a pattern of raised print features to receive ink material thereon, the inner layer is softer and thicker than the thin outer shell;

providing an impression roll adjacent to the printing roll to form a nip;

supplying a liquid ink onto the pattern of raised print features of the printing roll; and applying an impression force to press the printing roll and the web against each other to transfer the liquid ink from the printing roll to the web to form the pattern of features;

wherein the inner layer of the printing roll has a thickness, a compression force deflection value, and an elastically-deformable compressibility such that when the printing roll and the impression roll are pressed against each other with a roll engagement depth in a range from about 0 to 1.5 mm, the raised print features do not slide or deform with respect to the web in an amount to generate a substantially visible dot gain.

2. The method of claim 1, wherein the thin outer shell and the inner layer have a thickness ratio not greater than about 0.5.

3. The method of claim 1, further comprising advancing the web along a machine direction through the nip.

4. The method of claim 1, wherein the printing roll is pressed with an impression in a range from about 0.0254 to 0.508 mm (1 to 20 mils) with respect to a printing "zero" impression.

5. The method of claim 1, further comprising providing an inking roll, wherein the liquid ink is transferred from the inking roll to the printing roll.

6. A printing system comprising:

a printing roll comprising an elastically deformable and compressible inner layer and a thin outer shell to cover the inner layer, wherein the thin outer shell includes a pattern of raised print features to receive ink material thereon, the inner layer is softer and thicker than the thin outer shell, and the thin outer shell and the inner layer have a thickness ratio not greater than about 0.5;

an impression roll positioned adjacent to the printing roll, and a nip formed between the printing roll and the impression roll; and a flexible web being advanced along a machine direction through the nip;

wherein the thin outer shell has a thickness in a range from about 1.52 mm (0.030 inch) to about 6.35 mm (0.250 inch).

7. The printing system of claim 6, wherein the inner layer of the printing roll has a thickness, a compression force deflection value, and an elastically-deformable compressibility such that when the printing roll and the impression roll are pressed against each other with a roll engagement depth in a range from about 0 to 1.5 mm, the raised print features do not slide or deform with respect to the web in an amount to generate a substantially visible dot gain.

8. The printing system of claim 6, wherein the inner layer of the printing roll has a compression force deflection of less than about 0.32 MPa (45 psi) at 25% deflection.

9. The printing system of claim 6, wherein the thin outer shell of the printing roll has a hardness greater than about 40 Shore A.

10. The printing system of claim 6, wherein the inner layer of the printing roll has a Poison's ratio less than 0.4.

11. The printing system of claim 6, wherein the thin outer shell made of a material with a Poison's ratio greater than 0.2.

12. The printing system of claim 6, wherein the outer shell of the printing roll made of a material with an elastic modulus of greater than 1.38 MPa (200 psi).

13. The printing system of claim 6, wherein the inner layer has a thickness in a range from about 3.18 mm (0.125 inch) to about 31.75 mm (1.25 inch).

14. The printing system of claim 6, wherein the thin outer shell includes one or more materials of an elastomer, a metal, a fabric, or a nonwoven.

15. The printing system of claim 6, wherein the inner layer includes one or more materials of a synthetic foam, an engraved, structured, 3D printed, or embossed elastomer, a fabric or nonwoven layer, a plurality of cavities filled with gas of a controlled pressure, or a soft rubber.

16. The printing system of claim 6, wherein the thin outer shell is removable from the inner layer.

17. A method of printing a pattern of features onto a web, the method comprising:

providing a printing roll comprising:

an elastically deformable and compressible inner layer and a thin outer shell to cover the inner layer, wherein the thin outer shell includes a pattern of raised print features to receive ink material thereon, the inner layer is softer and thicker than the thin outer shell;

supplying a liquid ink onto the pattern of raised print features of the printing roll; and applying an impression force to press the printing roll and the web against each other to transfer the liquid ink from the printing roll to the web to form the pattern of features;

wherein the printing roll is pressed with an impression in a range from about 0.0254 to 0.508 mm (1 to 20 mils) with respect to a printing "zero" impression.

* * * * *